US008740106B2

(12) United States Patent
Ryou et al.

(10) Patent No.: US 8,740,106 B2
(45) Date of Patent: Jun. 3, 2014

(54) ELASTIC CLIP FOR FIXING RAILWAY RAIL AND METHOD FOR INSTALLING THE SAME

(75) Inventors: Ki Tae Ryou, Gyeongsangbuk-do (KR); Eung-Dae You, Chungcheongnam-do (KR)

(73) Assignee: Sampyo Engineering & Construction Ltd., Seoul (KR)

( * ) Notice: Subject to any disclaimer, the term of this patent is extended or adjusted under 35 U.S.C. 154(b) by 97 days.

(21) Appl. No.: 13/237,803

(22) Filed: Sep. 20, 2011

(65) Prior Publication Data

US 2012/0080534 A1 Apr. 5, 2012

(30) Foreign Application Priority Data

Sep. 20, 2010 (KR) ..... 10-2010-0092376
Nov. 11, 2010 (KR) ..... 10-2010-0111925

(51) Int. Cl.
*E01B 9/00* (2006.01)
*E01B 13/00* (2006.01)

(52) U.S. Cl.
USPC ..... 238/338; 238/349

(58) Field of Classification Search
USPC ..... 238/338, 349–354
See application file for complete search history.

(56) References Cited

U.S. PATENT DOCUMENTS 4,304,359 A * 12/1981 Fischer ..... 238/349

* cited by examiner

*Primary Examiner* — R. J. McCarry, Jr.
(74) *Attorney, Agent, or Firm* — Sughrue Mion, PLLC

(57) ABSTRACT

An elastic clip for fixing a railway rail, comprising a head arch having a front end thereof inserted into a clip shoulder of a base plate or a tie; a first front arch extending in one piece from the head arch and upwardly curved in an oblique direction; a first toe extending in one piece from the first front arch and having a bottom thereof contacting a top of a flange of a rail; a second front arch extending in one piece from the first toe and upwardly curved in an oblique direction; and a second toe extending in one piece from the second front arch and having a top of a front end of thereof contacting a bottom of the head arch.

6 Claims, 16 Drawing Sheets

ELASTIC CLIP FOR FIXING RAILWAY RAIL AND METHOD FOR INSTALLING THE SAME

TECHNICAL FIELD

The following disclosure relates to an elastic clip for fixing a railway rail and a method for installing the same, which can not only firmly fix the rail, but also prevent plastic deformation of the elastic clip according to increase of stress in response to a frictional force between a load of the rail and a tie, and a ballast when the rail is lifted for ballast tamping and repair, use an existing clip shoulder installed on-site through a head arch front end extension, and enhance a coupling force with the clip shoulder by inserting the head arch front end extension into the clip shoulder.

DESCRIPTION OF RELATED ART

A railway rail may be fixedly installed to a tie with a clip shoulder directly connected to it or a base plate equipped with a clip shoulder.

In this case, fixation of the rail on the tie or the base plate is achieved by an elastic clip installed between the rail and the clip shoulder of the tie or the base plate.

A typical elastic clip 100' for fixing a railway rail, as shown in FIGS. 1 and 2, includes a head arch 10' having a front end thereof inserted into a clip shoulder 210 and 310 directly connected to a tie or equipped on a base plate, a front arch 20' extending from the head arch 10' in one piece, and a toe 30' extending from the front arch 20' in one piece. When the front end of the head arch 10' is inserted into the clip shoulder 210 and 310 of the base plate or the tie, the lower surface of the toe 30' is placed on the upper surface of a flange 410 of a rail 400. Thus, the rail 400 is fixed by an elastic force acting on the toe 30'.

Since heavy trains frequently travel on the railway rail 400, ballast tamping and repair of the rail 400 are frequently performed.

During the ballast tamping and repair, external forces are applied to the elastic clip 100' fixing the rail 400 when the rail 400 is lifted due to friction between the load of the rail 400 and tie, and the ballast.

In this case, since the typical elastic clip 100' does not include a means for preventing plastic deformation due to an increase of a stress responding to the external force as shown in FIG. 2, deformation relation according to the increase of the stress responding to the external force, as shown in FIG. 3, can show plastic deformation during the deformation between the toe 30' and the front arch 20' in the lifting process of the rail 400. Also, after plastic deformation, the coupling of the rail 400 may be weakened and lose its value as a product. Furthermore, deviation from the coupling state may cause negligent accidents.

For this reason, manufactures of elastic clips have made an attempt to develop an elastic clip for fixing a railway rail, which can prevent plastic deformation according to an increase of a stress responding to an external force. However, development of an elastic clip for fixing a railway rail, which can prevent plastic deformation according to an increase of a stress responding to an external force using an existing clip shoulder, has been totally absent.

SUMMARY

Accordingly, the present disclosure provides an elastic clip for fixing a railway rail and a method for installing the same to address the problems discussed above, which can firmly fix the rail and prevent the plastic deformation of the elastic clip according to increase of a stress in response to a frictional force between a load of the rail and a tie, and a ballast when the rail is lifted for ballast tamping and repair, use an existing clip shoulder installed on-site through a head arch front end extension therefore rendering it unnecessary to separately produce a clip shoulder, and enhance a coupling force with the clip shoulder by inserting the head arch front end extension into the clip shoulder and installing a third toe on the head arch extension.

In one exemplary aspect, an elastic clip for fixing a railway rail includes: a head arch having a front end thereof inserted into a clip shoulder of a base plate or a tie; a first front arch extending in one piece from the head arch and upwardly curved in an oblique direction; a first toe extending in one piece from the first front arch and having a bottom thereof contacting a top of a flange of a rail; a second front arch extending in one piece from the first toe and upwardly curved in an oblique direction; and a second toe extending in one piece from the front of the second front arch and having a top of a front end of thereof contacting a bottom of the head arch.

In another exemplary aspect, an elastic clip for fixing a railway rail includes: a head arch having a front end thereof inserted into a clip shoulder of a base plate or a tie; a first front arch extending in one piece from one end of the head arch and upwardly curved in an oblique direction; a first toe extending in one piece from the first front arch and having a bottom thereof contacting a top of a flange of a rail; a second front arch extending in one piece from the first toe and upwardly curved in an oblique direction; a second toe extending in one piece from the front of the second front arch and having a top of a front end of thereof contacting a bottom of the head arch; a head arch front end extension extending in one piece from the other end of the head arch by a certain length in a straight line; and a third toe extending in one piece from the front of the head arch front end extension while outwardly protruding from the clip shoulder, and having a top of a front end thereof upwardly curved in an oblique direction.

In some exemplary aspects, an elastic clip for fixing a railway rail includes: a head arch having a front end thereof inserted into a clip shoulder of a base plate or a tie; a first front arch extending in one piece from the head arch and upwardly curved in an oblique direction; a first toe extending in one piece from the first front arch and having a bottom thereof contacting a top of a flange of a rail; a head arch front extension extending in one piece from the other end of the head arch by a certain length in a straight line; and a third toe extending in one piece from the front of the head arch front extension while outwardly protruding from the clip shoulder, and having a top of a front end of thereof upwardly curved in an oblique direction.

In another exemplary aspect, a method for installing an elastic clip for fixing a railway rail comprises a method whereby an elastic clip for fixing a railway rail described above is installed to a clip shoulder.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

BRIEF DESCRIPTION OF DRAWINGS

The accompanying drawings, which are incorporated in and constitute a part of this specification, illustrate various embodiments consistent with the invention and, together with the description, serve to explain the principles of the invention.

DETAILED DESCRIPTION

Figure 1:
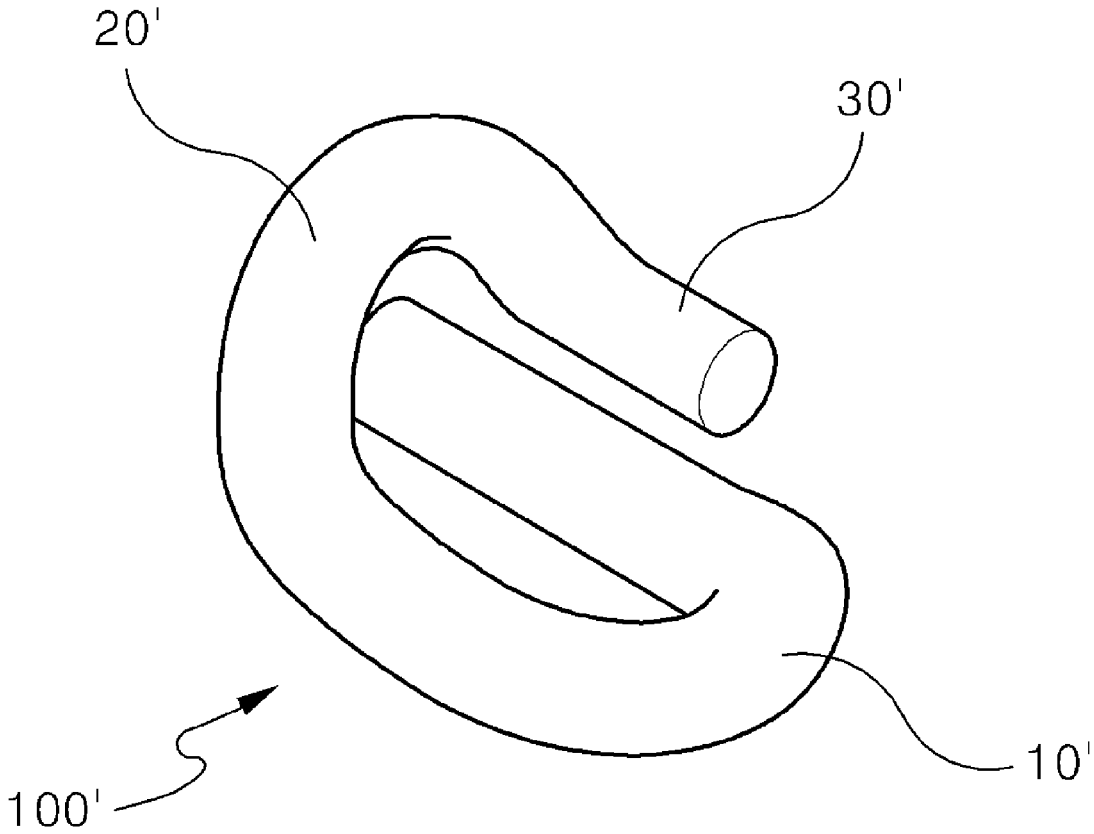
FIG. 1 PRIOR ART
FIG. 1 is a perspective view illustrating an elastic clip for fixing a railway rail.
Figure 2:
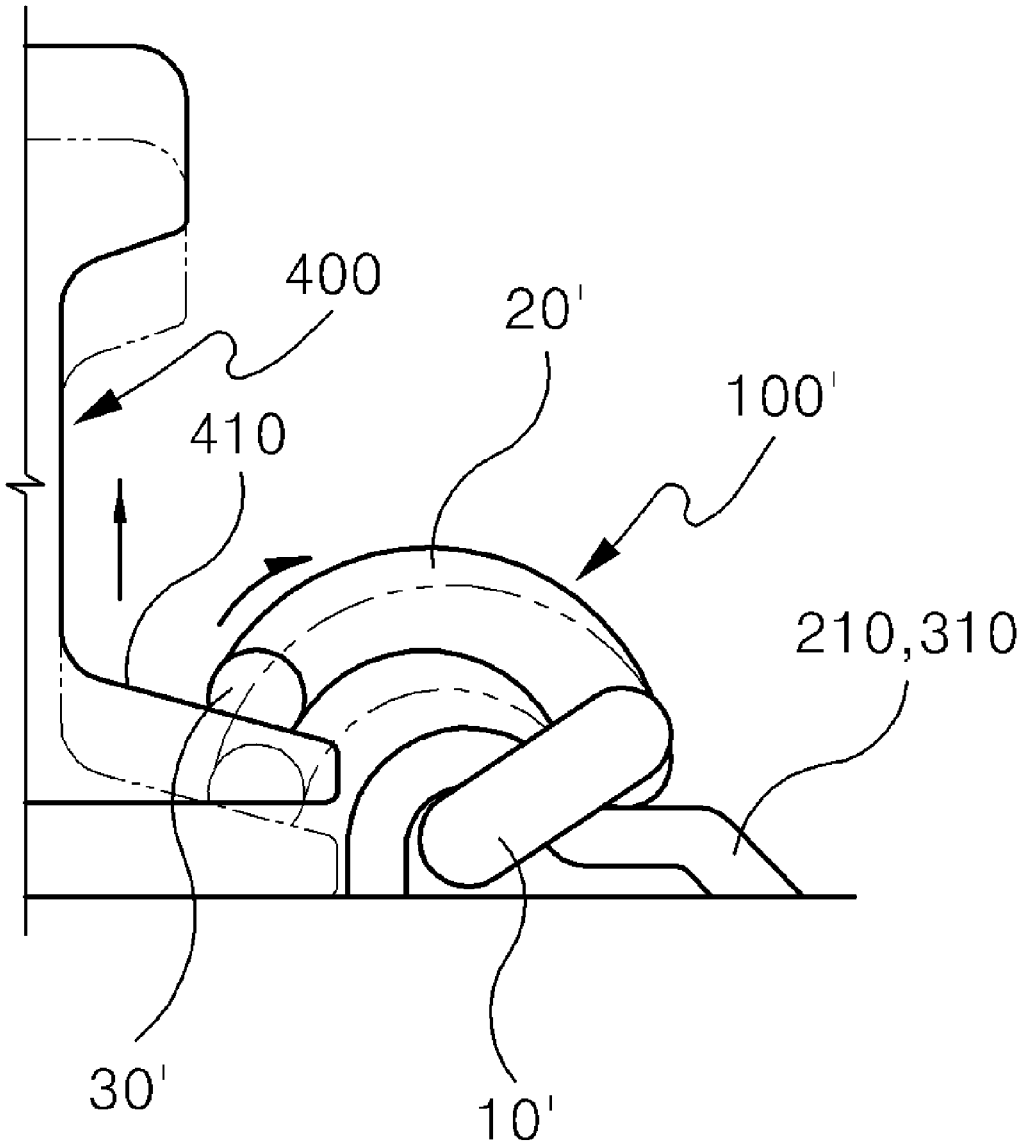
FIG. 2 PRIOR ART
FIG. 2 is a front view illustrating a deformation state of an elastic clip for fixing a typical railway rail during lifting of the rail.
Figure 3:
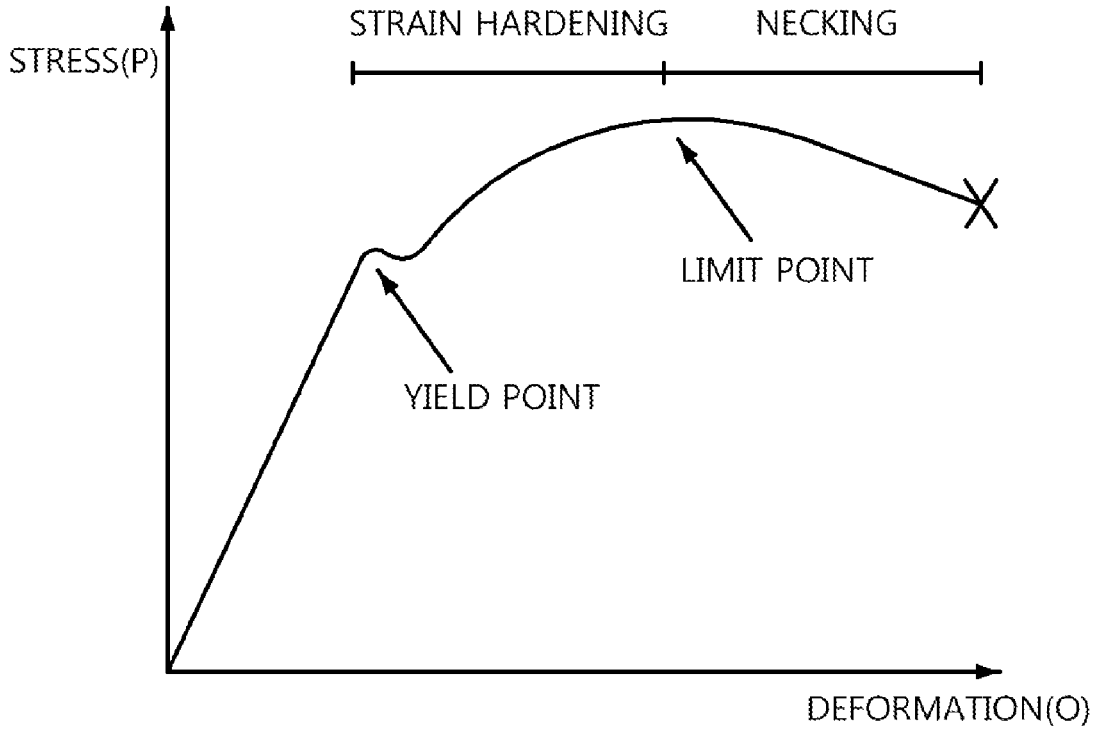
FIG. 3 PRIOR ART
FIG. 3 is a graph illustrating a relation between stress and deformation of an elastic clip for fixing a typical railway rail.

Hereinafter, exemplary embodiments will be described in detail with reference to the accompanying drawings. Wherever possible, the same reference characters will be used throughout the drawings to refer to the same or like parts.

As described above, elastic clips for fixing a railway rail according to various embodiments of the present invention may have the following advantages.

First, the present invention may include in one exemplary aspect: a head arch having a front end thereof inserted into a clip shoulder of a base plate or a tie; a first front arch extending in one piece from the head arch and upwardly curved in an oblique direction; a first toe extending in one piece from the first front arch and having a bottom thereof contacting a top of a flange of a rail; a second front arch extending in one piece from the first toe and upwardly curved in an oblique direction; and a second toe extending in one piece from the front of the second front arch and having a top of a front end of thereof contacting a bottom of the head arch. When a stress responding to an external force between a first front arch and a first toe during lifting of a rail for ballast tamping and repair increases, even though the stress further increases due to an additional external force in a state where a second toe is caught on the bottom of a head arch, a range of deformation can be limited. Accordingly, since plastic deformation due to the increase of the stress responding to the external force can be prevented, the rail can be firmly fixed even after the lifting of the rail.

Second, the present invention may include in another aspect: a head arch having a front end thereof inserted into a clip shoulder of a base plate or a tie; a first front arch extending in one piece from one end of the head arch and upwardly curved in an oblique direction; a first toe extending in one piece from the first front arch and having a bottom thereof contacting a top of a flange of a rail; a second front arch extending in one piece from the first toe and upwardly curved in an oblique direction; a second toe extending in one piece from the front of the second front arch and having a top of a front end of thereof contacting a bottom of the head arch; a head arch front end extension extending in one piece from the other end of the head arch by a certain length in a straight line; and a third toe extending in one piece from the front of the head arch front end extension while outwardly protruding from the clip shoulder, and having a top of a front end thereof upwardly curved in an oblique direction. Elastic clips for fixing a railway rail can be compatibly used with existing clip shoulders. Also, since elastic clips penetrate through and extend from clip shoulders, they can perform a locking function that maintains a strong coupling state after installation on-site.

Third, the present invention may include in another aspect: a head arch having a front end thereof inserted into a clip shoulder of a base plate or a tie; a first front arch extending in one piece from the head arch and upwardly curved in an oblique direction; a first toe extending in one piece from the first front arch and having a bottom thereof contacting a top of a flange of a rail; a head arch front extension extending in one piece from the other end of the head arch by a certain length in a straight line; and a third toe extending in one piece from the front of the head arch front extension while outwardly protruding from the clip shoulder, and having a top of a front end of thereof upwardly curved in an oblique direction. Since the first toe and the first toe front end extension pushes a flange of a rail, the rail can be continuously and firmly fixed, even after the lifting of the rail. Also, since elastic clips can be compatibly used with existing clip shoulders, and penetrate through and extend from the clip shoulders, it is possible to maintain a strong coupling state after installation on-site.

[Exemplary Embodiment 1]

Figure 4:
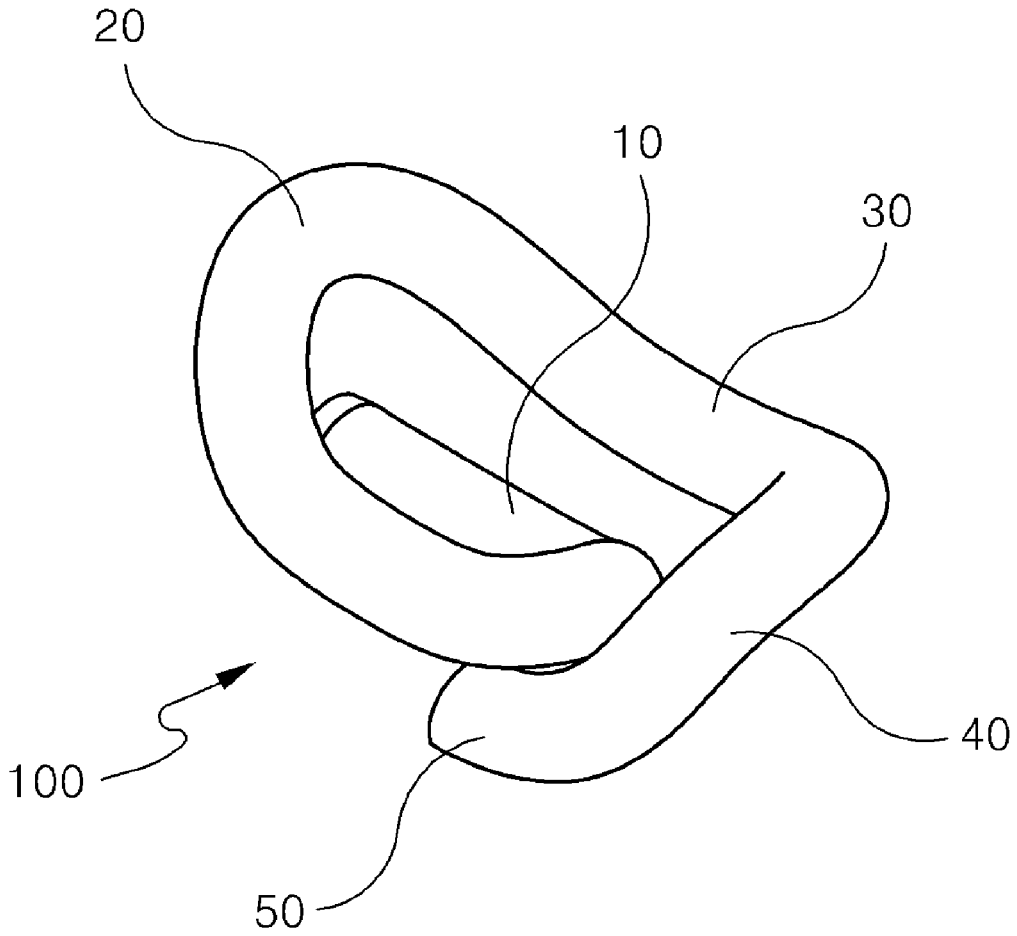
FIG. 4 is a perspective view illustrating an elastic clip for fixing a railway rail according to an embodiment of the present invention.

FIG. 4 is a perspective view illustrating an elastic clip for fixing a railway rail according to an embodiment of the present invention.

As shown in FIG. 4, an elastic clip 100 for fixing a railway rail may include a head arch 10 having a front end thereof inserted into a clip shoulder 210 or 310 of a base plate 300 or a tie 200, a first front arch 20 extending in one piece from the head arch 10 and upwardly curved in an oblique direction, a first toe 30 extending in one piece from the first front arch 20 and having a bottom thereof contacting a top of a flange 410 of a rail 400, a second front arch 40 extending in one piece from the first toe 30 and upwardly curved in an oblique direction, and a second toe 50 extending in one piece from the second front arch 40 and having a top of a front end of thereof contacting a bottom of the head arch 10.

As shown in FIG. 4, the elastic clip 100 for fixing the railway rail may have a structure in which the head arch 10, the first front arch 20, the first toe 30, the second front arch 40, and the second toe 50 are formed in one piece.

Here, the head arch 10 may be inserted into the clip shoulder 210 or 310 of the base plate 300 or the tie 200.

The front end of the head arch 10 may be formed to have a straight cylindrical shape having a uniform diameter.

Accordingly, since the front end of the head arch 10 is formed in a straight shape having a uniform diameter, the front end of the head arch 10 may be easily inserted into the clip shoulder 210 or 310.

The first front arch 20 may extend in one piece from the head arch 10 and may be upwardly curved in an oblique direction.

In this case, the first front arch 20 may be upwardly curved in an oblique direction such that an elastic force delivered to the first toe 30 may be downwardly applied.

The first toe 30 may extend in one piece from the first front arch 20, and the bottom of the first toe 30 may contact the top of the flange 410 of the rail 400.

The bottom of the first toe 30, i.e., the surface contacting the top of the flange 410 of the rail 400 may be formed to be flat through a partial cutting or forging process.

Thus, due to its flatness through a partial cutting or forging process, the bottom of the first toe 30 may have a relatively wider area contacting the top of the flange 410 of the rail 400.

The second front arch 40 may extend in one piece from the first toe 30, and may be upwardly curved in an oblique direction.

In this case, the second front arch 40 may be upwardly curved in an oblique direction such that an elastic force delivered to the second toe 50 may be downwardly applied.

The second toe 50 may extend in one piece from the second front arch 40, and the top of the front end thereof may approach the bottom of the head arch 10.

The bottom of the second toe 50 may be formed to be flat through a partial cutting or forging process.

Thus, due to its flatness through a partial cutting or forging process, the bottom of the second toe 50 may have a relatively wider area contacting the top of the base plate 300 or the tie 200.

Hereinafter, rail fixation using an elastic clip for fixing a railway rail according to an embodiment of the present invention will be described in detail with reference to the accompanying drawings.

Figure 5:
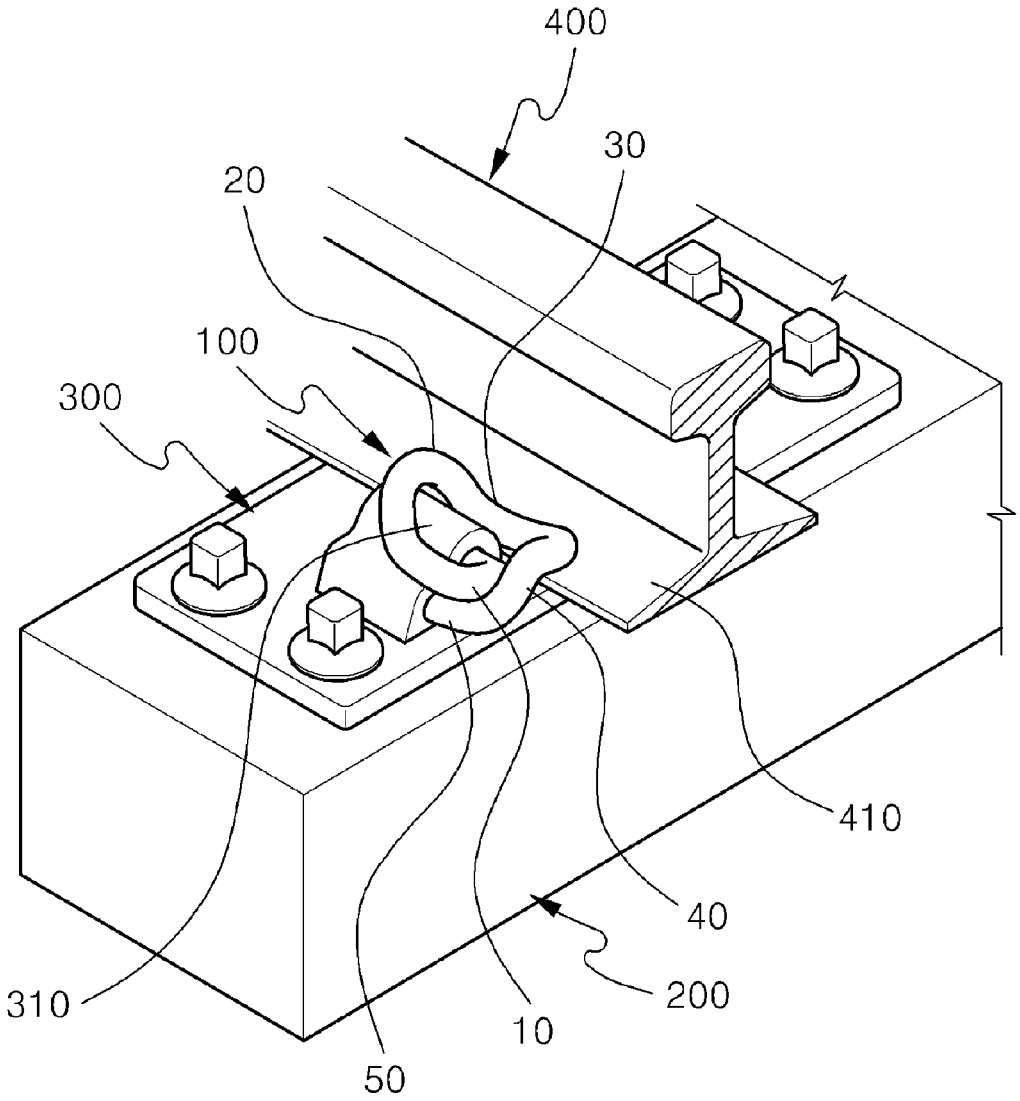
FIGS. 5 and 6 are perspective views illustrating a rail fixed using an elastic clip for fixing a railway rail according to an embodiment of the present invention.
Figure 6:
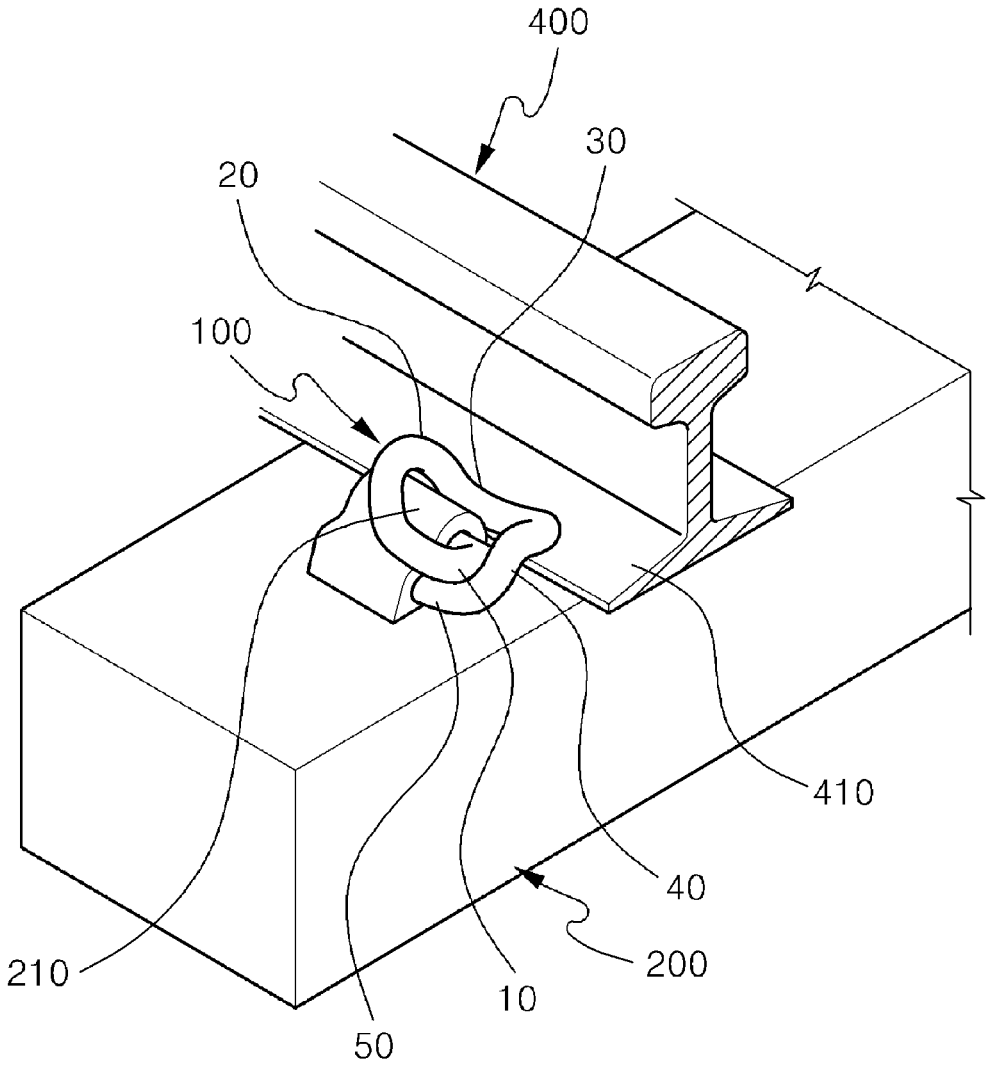

FIGS. 5 and 6 are perspective views illustrating a rail fixed using an elastic clip for fixing a railway rail according to an embodiment of the present invention.

As shown in the drawings, for installation of the rail 400 of the elastic clip 100 for fixing a railway rail, the front end of the head arch 10 of the elastic clip 100 may be inserted into the clip shoulder 210 or 310 of the base plate 300 or the tie 200, and then the front arch 20 may be placed on the top of the clip shoulder 210 or 310. Thereafter, the bottom of the first toe 30 may be placed on the top of the flange 410 of the rail, and then the front end of the second toe 50 may be disposed under the head arch 10.

Thus, since an elastic force is applied to the first toe 30 in a state where the elastic clip 100 is installed in the clip shoulder 210 or 310 to allow the top of the flange 410 of the rail 400 to be pushed down, the rail 400 may be fixed on the top of the base plate 300 or the tie 200.

In the elastic clip 100 for fixing a railway rail, since plastic deformation due to an increase of a stress responding to an external force applied to the first front arch 20 and the first toe 30 is prevented during the lifting of the rail 400 for ballast tamping and repair, the rail 400 can be continuously and firmly fixed, even after the lifting of the rail 400.

Figure 7:
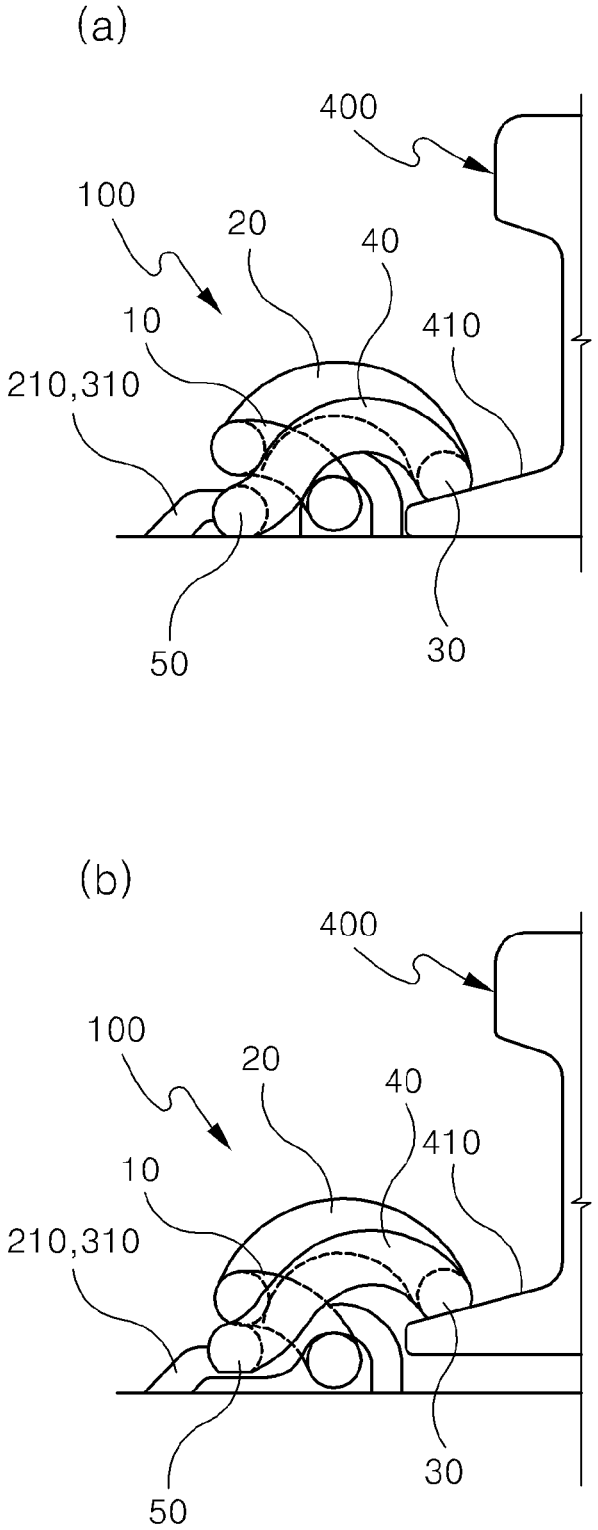
FIGS. 7(*a*) and (*b*) are front views illustrating a deformation state of an elastic clip for fixing a railway rail before and after lifting of the rail according to an embodiment of the present invention.

As shown in FIG. 7(*a*), after the elastic clip 100 is installed in the clip shoulder 210 or 310, a gap of about 0.2 mm to about 2.0 mm may occur between the top of the second toe 50 and the bottom of the head arch 10 due to deformation caused by torsion in a state where the rail 400 is fixed.

As described above, when the rail 400 is lifted in a state where the gap of about 0.2 mm to about 2.0 mm occurs between the top of the second toe 50 and the bottom of the head arch 10, an external force may be applied between the first front arch 20 and the second toe 50 to cause a stress and a deformation. Accordingly, as shown in FIG. 7(*b*), the top of the front end of the second toe 50 may come in contact with the bottom of the head arch 10.

Also, since the contact between the top of the second toe 50 and the bottom of the head arch 10 is continuously maintained unless an external force applied between the first front arch 20 and the first toe 30 decreases to reduce a stress responding thereto or the top of the second toe 50 is separated from the bottom of the head arch 10, a deformation between the first front arch 20 and the first toe 30 may be limited even though a stress increases due to an additional external force between the first front arch 20 and the first toe 30.

Figure 8:
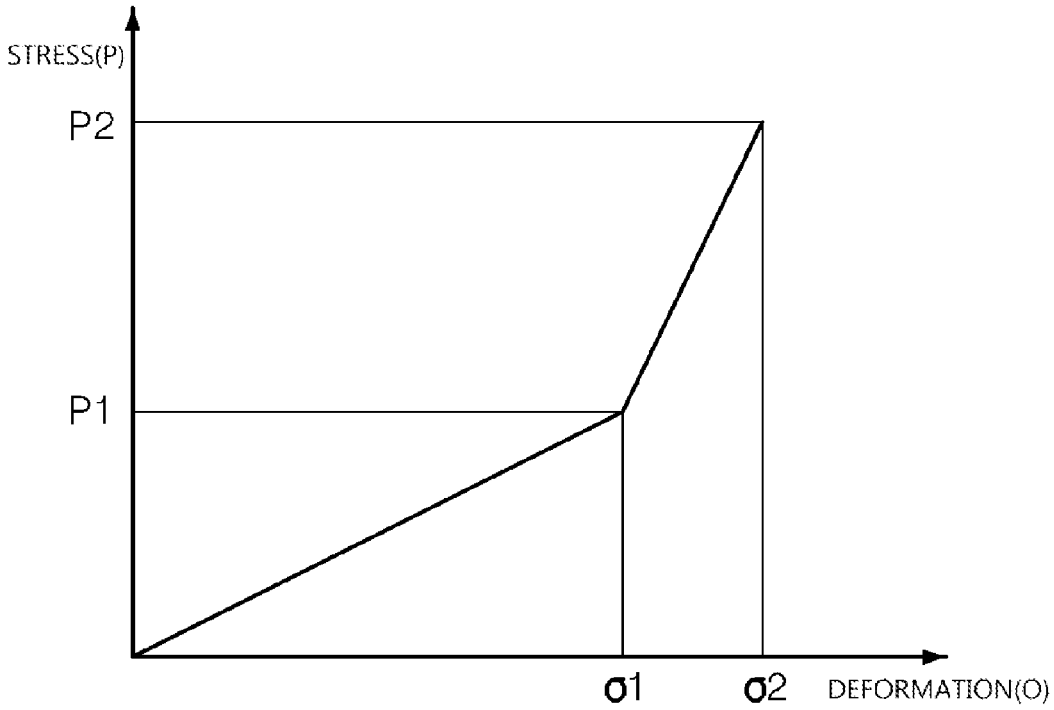
FIG. 8 is a graph illustrating a relation between stress and deformation of an elastic clip for fixing a railway rail according to an embodiment of the present invention.

Accordingly, the elastic clip 100, as shown in FIG. 8, can prevent a plastic deformation according to an increase of a stress responding to an external force because the deformation is limited to a narrow range despite an increase of a stress. Accordingly, even after the rail 400 is lifted for ballast tamping and repair, the rail 400 can be firmly fixed.

[Exemplary Embodiment 2]

Figure 9:
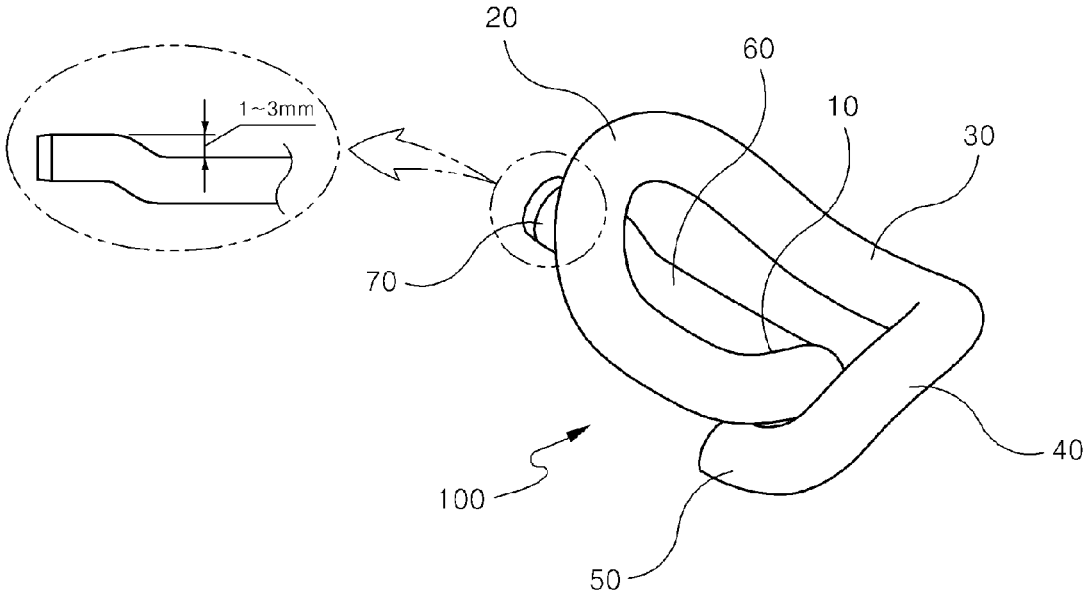
FIG. 9 is a perspective view illustrating an elastic clip for fixing a railway rail according to another embodiment of the present invention.

FIG. 9 is a perspective view illustrating an elastic clip for fixing a railway rail according to another embodiment of the present invention.

As shown in FIG. 9, an elastic clip 100 for fixing a railway rail may include a head arch 10 having a front end thereof inserted into a clip shoulder 210 or 310 of a base plate 300 or a tie 200, a first front arch 20 extending in one piece from one end of the head arch 10 and upwardly curved in an oblique direction, a first toe 30 extending in one piece from the first front arch 20 and having a bottom thereof contacting a top of a flange 410 of a rail 400, a second front arch 40 extending in one piece from the first toe 30 and upwardly curved in an oblique direction, a second toe 50 extending in one piece from the second front arch 40 and having a top of a front end of thereof contacting a bottom of the head arch 10, a head arch front end extension 60 extending in one piece from the other end of the head arch 10 by a certain length in a straight line, and a third toe 70 extending in one piece from the head arch front end extension 60, outwardly protruding from the clip shoulder 210 or 310, and having a top of a front end thereof upwardly curved in an oblique direction.

As shown in FIG. 9, the elastic clip 100 for fixing the railway rail may have a structure in which the head arch 10, the first front arch 20, the first toe 30, the second front arch 40, the second toe 50, the head arch front end extension 60, and the third toe 70 are formed in one piece.

Here, the head arch 10 may be inserted into the clip shoulder 210 or 310 of the base plate 300 or the tie 200.

The front end of the head arch 10 may be formed to have a straight cylindrical shape having a uniform diameter.

Accordingly, since the front end of the head arch 10 is formed in a straight shape having a uniform diameter, the front end of the head arch 10 may be easily inserted into the clip shoulder 210 or 310.

The first front arch 20 may extend in one piece from the head arch 10 and may be upwardly curved in an oblique direction.

In this case, the first front arch 20 may be upwardly curved in an oblique direction such that an elastic force delivered to the first toe 30 may be downwardly applied.

The first toe 30 may extend in one piece from the first front arch 20, and the bottom of the first toe 30 may contact the top of the flange 410 of the rail 400.

The bottom of the first toe 30, i.e., the surface contacting the top of the flange 410 of the rail 400 may be formed to be flat through a partial cutting or forging process.

Thus, due to its flatness through a partial cutting or forging process, the bottom of the first toe 30 may have a relatively wider area contacting the top of the flange 410 of the rail 400.

The second front arch 40 may extend in one piece from the first toe 30, and may be upwardly curved in an oblique direction.

In this case, the second front arch 40 may be upwardly curved in an oblique direction such that an elastic force delivered to the second toe 50 may be downwardly applied.

The second toe 50 may extend in one piece from the second front arch 40, and the top of the front end thereof may contact the bottom of the head arch 10.

The bottom of the second toe 50 may be formed to be flat through a partial cutting or forging process.

Thus, due to its flatness through a partial cutting or forging process, the bottom of the second toe 50 may have a relatively wider area contacting the top of the base plate 300 or the tie 200.

The head arch front end extension 60 may extend in one piece from the head arch 10 inserted into the clip shoulder 210 or 310 of the base plate 300 or the tie 200, and may be formed to have a straight cylindrical shape having a uniform diameter.

Since the head arch front end extension 60 is formed to have a straight cylindrical shape having the uniform diameter as the head arch, the head arch front end extension 60 can be easily inserted into the clip shoulder 210 or 310, and an contact area with the inside of the clip shoulder 210 or 310 may increase.

Also, the third toe 70 may extend in one piece from the head arch front end extension 60 while outwardly protruding from the clip shoulder 210 or 310, and the top of the front end thereof may be upwardly curved in an oblique direction to contact the top of the flange 410 of the rail 400.

Here, the third toe 70 may extend from the head arch 10 by a length of about 2 mm to about 15 mm, and the top of the front end thereof may protrude from a straight portion of the head arch front end extension 60 by a length of about 0.5 mm to about 3.0 mm.

In this case, the reason why the third toe 70 is upwardly curved in an oblique direction is to make it difficult to be disassembled unless an artificial force is applied after the third toe 70 is coupled to the clip shoulder 210 or 310. Accordingly, it is desirable for third toe 70 to be curved in an oblique direction.

Thus, since the third toe 70 penetrates through the clip shoulder 210 or 310 and outwardly protrudes from the clip shoulder 210 or 310, it may perform a locking function that maintains firm coupling after installation of the elastic clip 100 on-site.

In other words, when the elastic clip 100 is installed in the clip shoulder 210 or 310, the third toe 70 may penetrate through the clip shoulder 210 or 310 to allow the top of the front end thereof to outwardly protrude from the clip shoulder 210 or 310. Accordingly, upon installation, when the third toe penetrates through the clip shoulder 210 or 310, the top of the front end thereof may contact the side surface of the clip shoulder 210 or 310 to facilitate the installation. On the other hand, upon disassembling, the elastic clip 100 may be easily removed from the clip shoulder 210 or 310 by hitting the extension portion of the third toe 70 with a tool.

Hereinafter, rail fixation using an elastic clip for fixing a railway rail according to another embodiment of the present invention will be described in detail with reference to the accompanying drawings.

Figure 10:
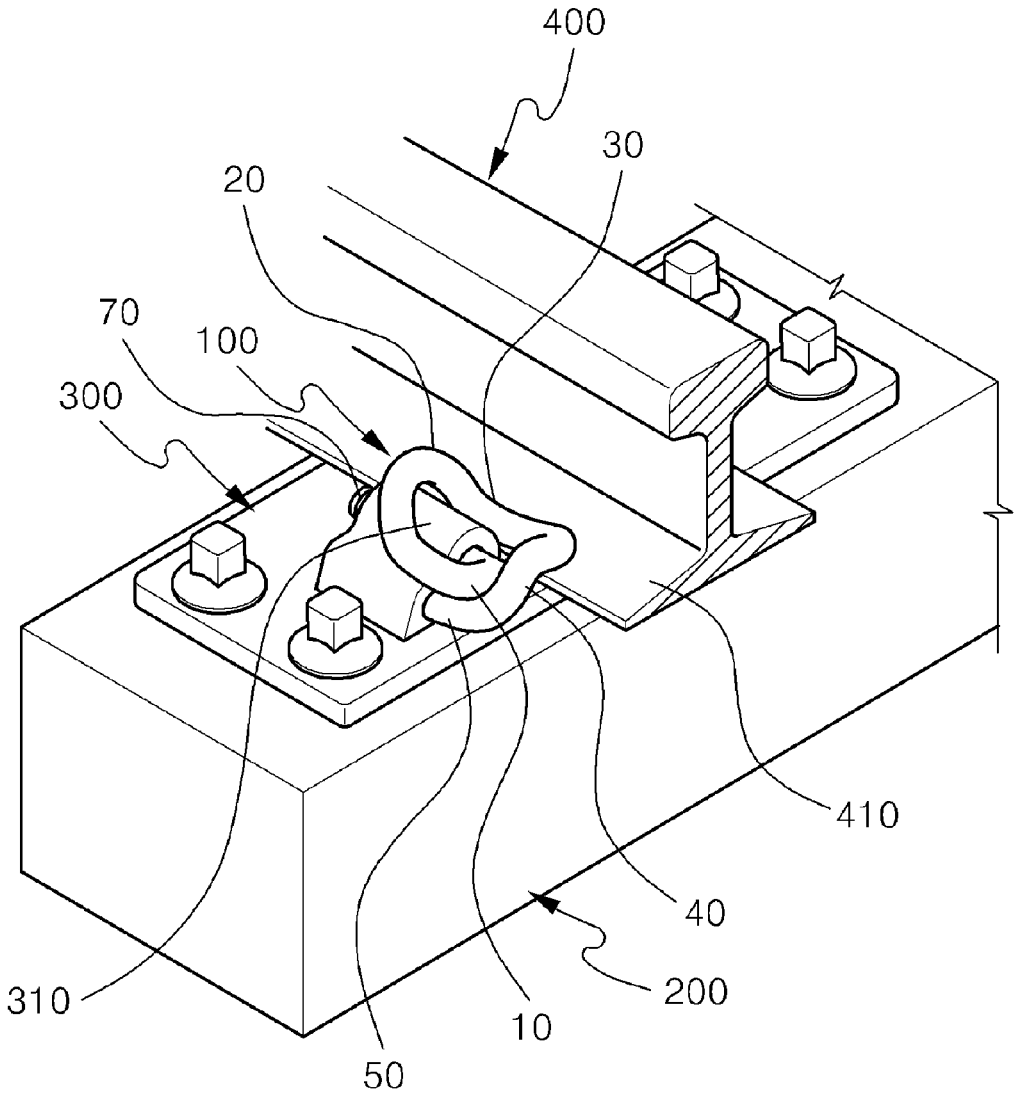
FIGS. 10 and 11 are perspective views illustrating a rail fixed using an elastic clip for fixing a railway rail according to another embodiment of the present invention.
Figure 11:
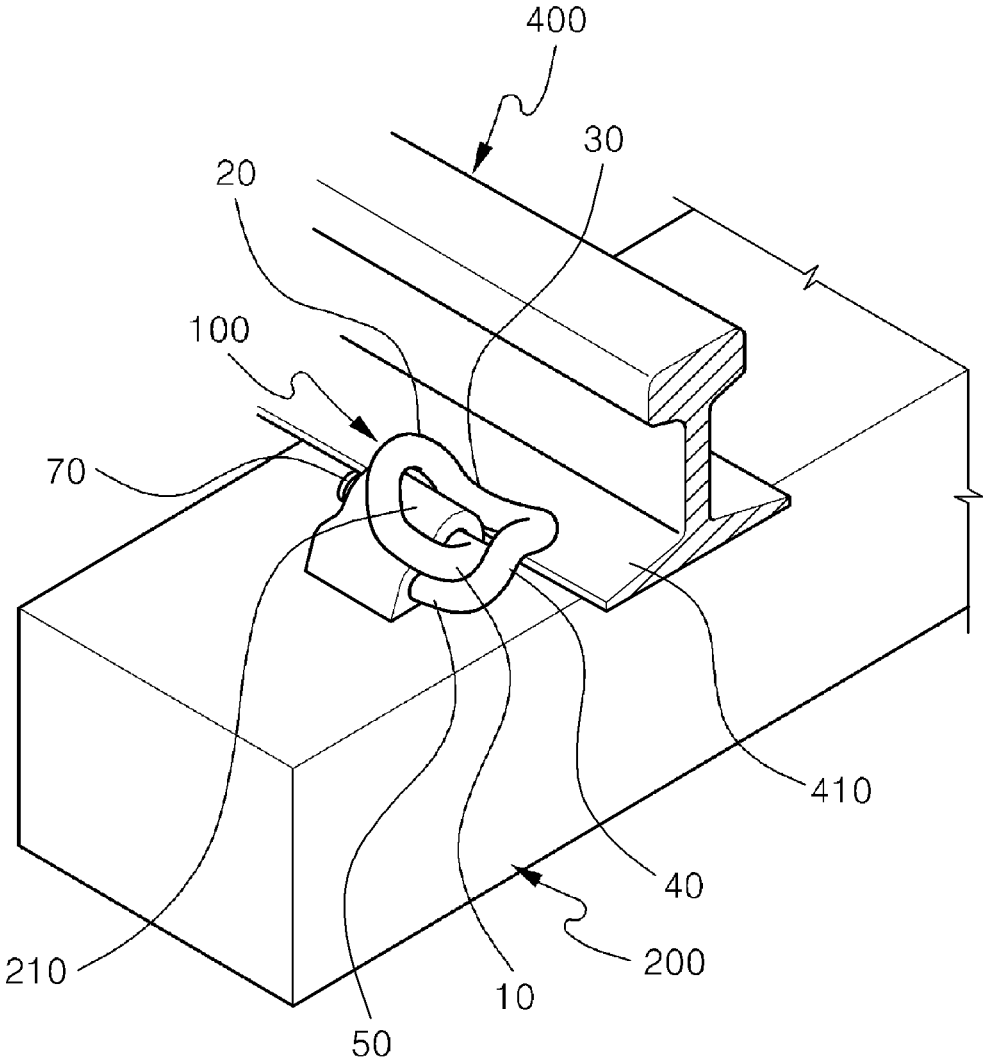

FIGS. 10 and 11 are perspective views illustrating a rail fixed using an elastic clip for fixing a railway rail according to another embodiment of the present invention.

As shown in the drawings, for installation of the rail 400 of the elastic clip 100 for fixing a railway rail, the front end of the head arch 10 of the elastic clip 100 may be inserted into and penetrate through the clip shoulder 210 or 310 of the base plate 300 or the tie 200. Thereafter, the bottom of the third toe 70 may be placed on the inside of the clip shoulder 210 or 310, and then the front end for the second toe 50 may be located under the head arch 10.

Thus, since an elastic force is applied to the first toe 30 in a state where the elastic clip 100 is installed in the clip shoulder 210 or 310 to allow the top of the flange 410 of the rail 400 to be pushed down, the rail 400 may be fixed on the top of the base plate 300 or the tie 200.

In this case, the elastic clip 100 for fixing a railway rail can prevent plastic deformation due to an increase of a stress responding to an external force applied to the first front arch 20 and the first toe 30 during the lifting of the rail 400 for ballast tamping and repair, and can firmly fix the rail 400 continuously even after the lifting of the rail 400. Particularly, the elastic clip 100 may be installed in an already-installed clip shoulder 210 and 310 to maintain a strong coupling state.

As shown in FIGS. 10 and 11, after the elastic clip 100 is installed in the clip shoulder 210 or 310, a gap of about 0.5 mm to about 3.0 mm may occur between the top of the third toe 70 and the top of the head arch front end extension 60 due to deformation caused by torsion in a state where the rail 400 is fixed.

When the rail 400 is lifted in such a state, an external force may be applied between the first front arch 20 and the second toe 50 to cause a stress and a deformation. Accordingly, the top of the front end of the second toe 50 may become in contact with the bottom of the head arch 10.

Also, since the contact between the top of the second toe 50 and the bottom of the head arch 10 is continuously maintained unless an external force applied between the first front arch 20 and the first toe 30 decreases to reduce a stress responding thereto or the top of the second toe 50 is separated from the head arch 10, a deformation between the first front arch 20 and the first toe 30 may be limited even though a stress increases due to an additional external force between the first front arch 20 and the first toe 30.

Accordingly, the elastic clip 100, as shown in FIG. 9, can prevent a plastic deformation according to an increase of a stress responding to an external force because the deformation is limited to a narrow range despite an increase of a stress, and coupling and disassembling of the clip shoulder 210 or 310 and the elastic clip 100 may be easily performed. Accordingly, even after the rail 400 is lifted for ballast tamping and repair, the rail 400 can be firmly fixed. Also, since a compatible elastic clip 100 is used to utilize an already-installed clip shoulder 210 or 310, it is unnecessary to manufacture a separate clip shoulder.

[Exemplary Embodiment 3]

Figure 12:
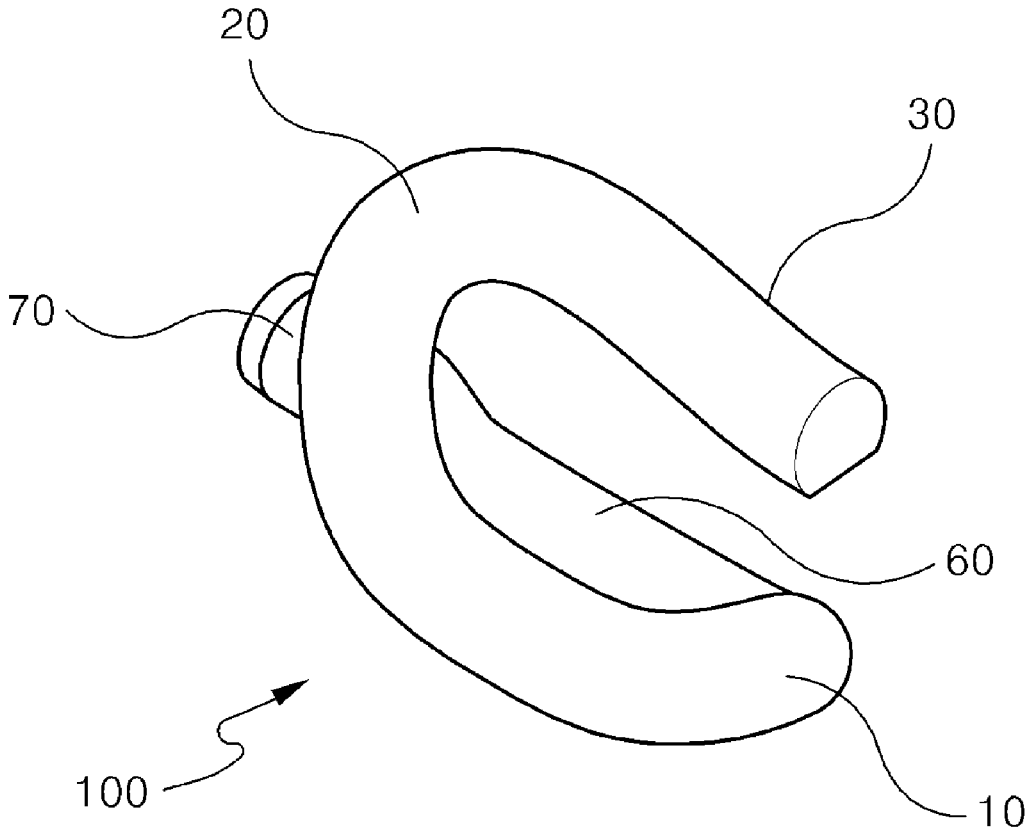
FIG. 12 is a perspective view illustrating an elastic clip for fixing a railway rail according to still another embodiment of the present invention.

FIG. 12 is a perspective view illustrating an elastic clip for fixing a railway rail according to still another embodiment of the present invention As shown in FIG. 12, an elastic clip 100 for fixing a railway rail may include a head arch 10 having a front end thereof inserted into a clip shoulder 210 or 310 of a base plate 300 or a tie 200, a first front arch 20 extending in one piece from the head arch 10 and upwardly curved in an oblique direction, a first toe 30 extending in one piece from the first front arch 20 and having a bottom thereof contacting a top of a flange 410 of a rail 400, a head arch front end extension 60 extending in one piece from the other end of the head arch 10 by a certain length in a straight line, and a third toe 70 extending in one piece from the head arch front end extension 60, outwardly protruding from the clip shoulder 210 or 310, and having a top of a front end thereof upwardly curved in an oblique direction.

As shown in FIG. 12, the elastic clip 100 for fixing the railway rail may have a structure in which the head arch 10, the first front arch 20, the first toe 30, the head arch front end extension 60, and the third toe 70 are formed in one piece.

Here, the head arch 10 may be inserted into the clip shoulder 210 or 310 of the base plate 300 or the tie 200.

The front end of the head arch 10 may be formed to have a straight cylindrical shape having a uniform diameter.

Accordingly, since the front end of the head arch 10 is formed in a straight shape having a uniform diameter, the front end of the head arch 10 may be easily inserted into the clip shoulder 210 or 310.

The first front arch 20 may extend in one piece from the head arch 10 and may be upwardly curved in an oblique direction.

In this case, the first front arch 20 may be upwardly curved in an oblique direction such that an elastic force delivered to the first toe 30 may be downwardly applied.

The first toe 30 may extend in one piece from the first front arch 20, and the bottom of the first toe 30 may contact the top of the flange 410 of the rail 400.

The bottom of the first toe 30, i.e., the surface contacting the top of the flange 410 of the rail 400 may be formed to be flat through a partial cutting or forging process.

Thus, due to its flatness through a partial cutting or forging process, the bottom of the first toe 30 may have a relatively wider area contacting the top of the flange 410 of the rail 400.

The head arch front end extension 60 may extend in one piece from the head arch 10 inserted into the clip shoulder 210 or 310 of the base plate 300 or the tie 200, and may be formed to have a straight cylindrical shape having a uniform diameter.

Since the head arch front end extension 60 is formed to have a straight cylindrical shape having the uniform diameter as the head arch, the head arch front end extension 60 can be easily inserted into the clip shoulder 210 or 310, and an contact area with the inside of the clip shoulder 210 or 310 may increase.

Also, the third toe 70 may extend in one piece from the head arch front end extension 60 while outwardly protruding from the clip shoulder 210 or 310, and the top of the front end thereof may be upwardly curved in an oblique direction to contact the top of the flange 410 of the rail 400.

Here, the third toe 70 may extend from the head arch 10 by a length of about 2 mm to about 15 mm, and the top of the front end thereof may protrude from a straight portion of the head arch front end extension 60 by a length of about 0.5 mm to about 3.0 mm.

In this case, the reason why the third toe 70 is upwardly curved in an oblique direction is to make it difficult to be disassembled unless an artificial force is applied after the third toe 70 is coupled to the clip shoulder 210 or 310. Accordingly, it is desirable for third toe 70 to be curved in an oblique direction.

Thus, since the third toe 70 penetrates through the clip shoulder 210 or 310 and outwardly protrudes from the clip shoulder 210 or 310, it may perform a locking function such that disassembling does not easily occur after installation of the elastic clip 100 on-site.

In other words, when the elastic clip 100 is installed in the clip shoulder 210 or 310, the third toe 70 may penetrate through the clip shoulder 210 or 310 to allow the top of the front end thereof to outwardly protrude from the clip shoulder 210 or 310. Accordingly, upon installation, when the third toe penetrates through the clip shoulder 210 or 310, the top of the front end thereof may contact the side surface of the clip shoulder 210 or 310 to facilitate the installation. On the other hand, upon disassembling, the elastic clip 100 may be easily removed from the clip shoulder 210 or 310 by hitting the extension portion of the third toe 70 with a tool.

Hereinafter, rail fixation using an elastic clip for fixing a railway rail according to another embodiment of the present invention will be described in detail with reference to the accompanying drawings.

Figure 13:
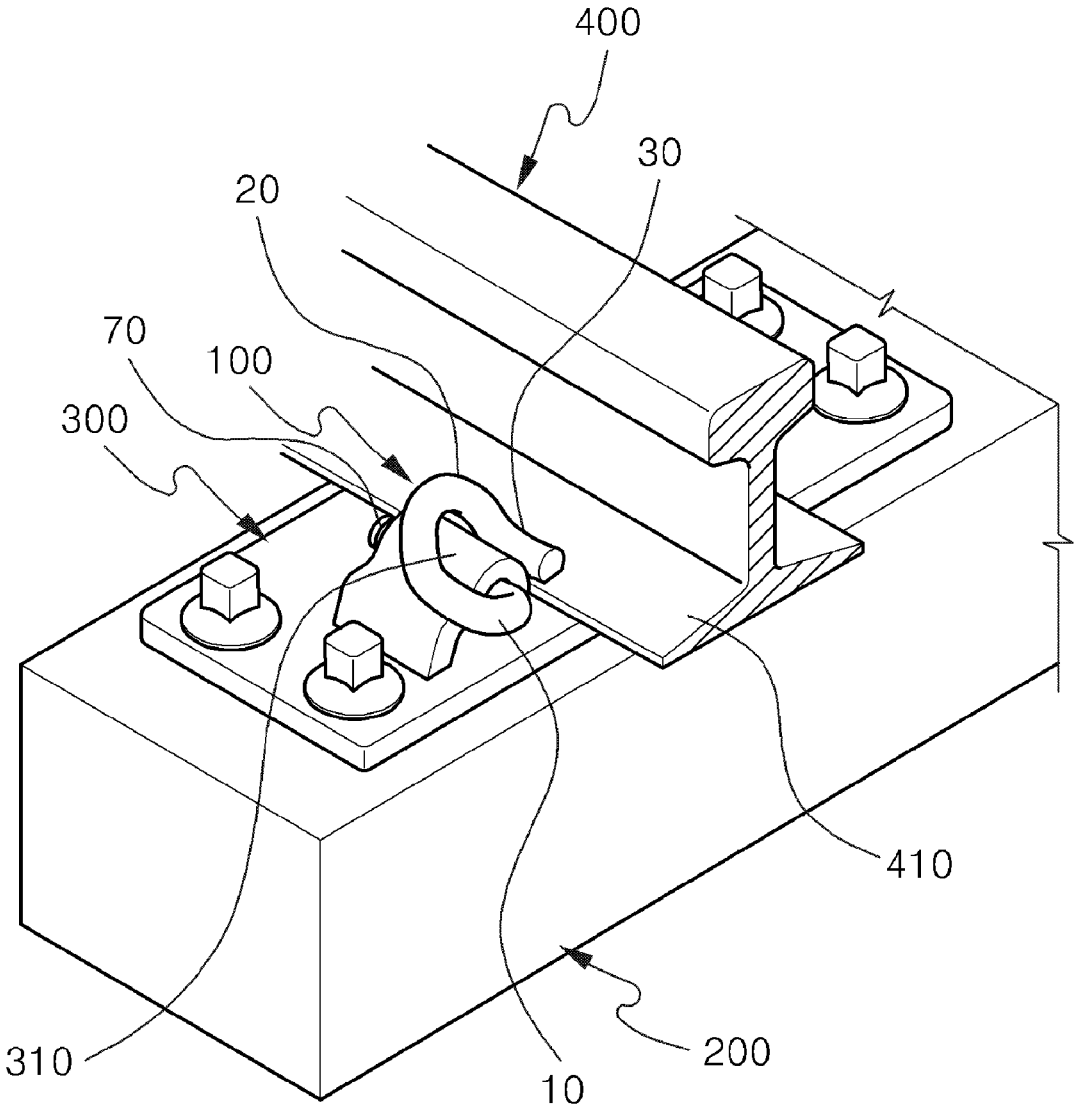
FIGS. 13 and 14 are perspective views illustrating a rail fixed using an elastic clip for fixing a railway rail according to still another embodiment of the present invention.
Figure 14:
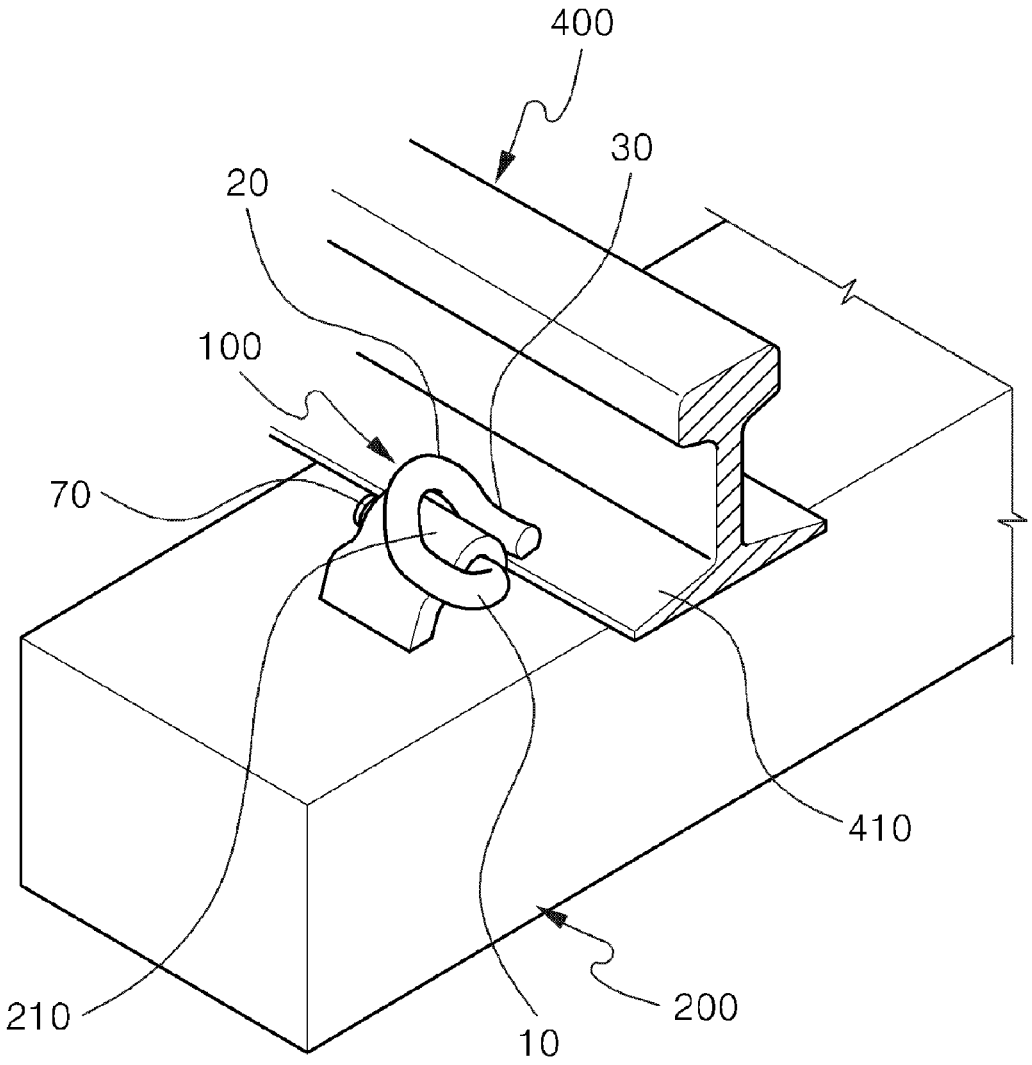

FIGS. 13 and 14 are perspective views illustrating a rail fixed using an elastic clip for fixing a railway rail according to still another embodiment of the present invention.

As shown in the drawings, for installation of the rail 400 of the elastic clip 100 for fixing a railway rail, the front end of the head arch 10 of the elastic clip 100 may be inserted into and penetrate through the clip shoulder 210 or 310 of the base plate 300 or the tie 200. Thereafter, the bottom of the third toe 70 may be placed on the inside of the clip shoulder 210 or 310.

Thus, since an elastic force is applied to the first toe 30 in a state where the elastic clip 100 is installed in the clip shoulder 210 or 310 to allow the top of the flange 410 of the rail 400 to be downwardly pushed, the rail 400 may be fixed on the top of the base plate 300 or the tie 200.

In this case, the elastic clip 100 for fixing a railway rail can prevent plastic deformation due to an increase of a stress responding to an external force applied to the first front arch 20 and the first toe 30 during the lifting of the rail 400 for ballast tamping and repair, and can firmly fix the rail 400 continuously even after the lifting of the rail 400. Particularly, since the third toe 70 penetrates through an already-installed clip shoulder 210 or 310 and protrudes from the clip shoulder 210 or 310, it may perform a locking function that maintains firm coupling after installation of the elastic clip 100 in site.

Figure 15:
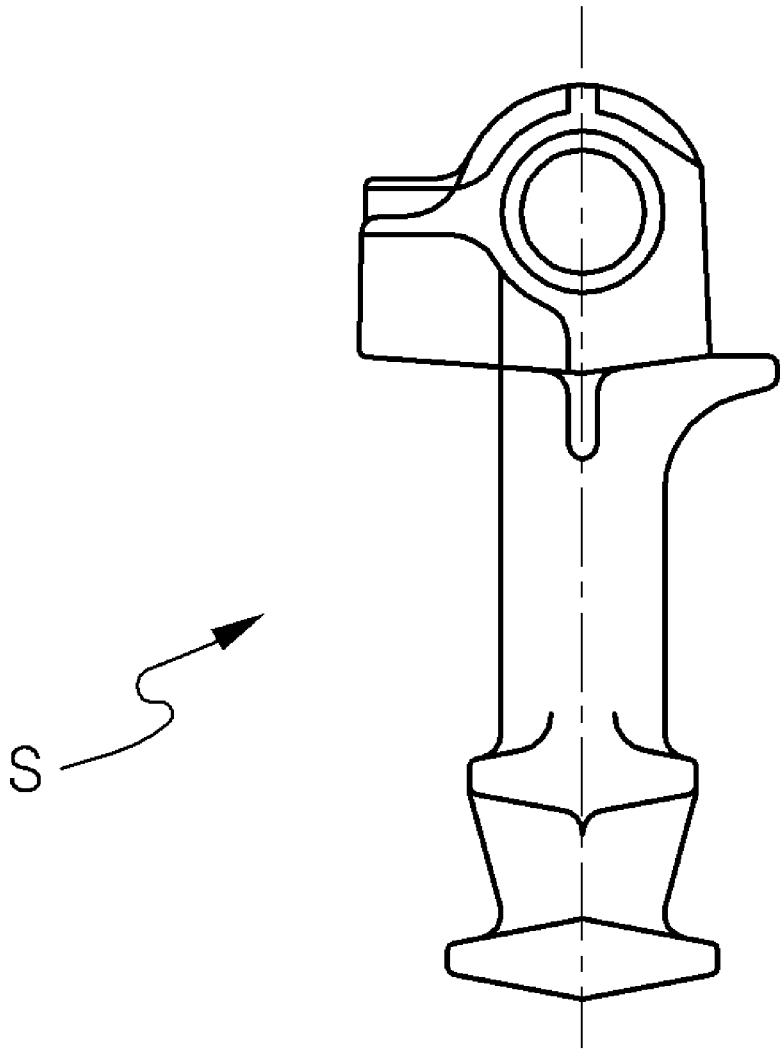
FIGS. 15 and 16 are views illustrating a clip shoulder in which an elastic clip for fixing a railway rail is installed according to an embodiment of the present invention.
Figure 16:
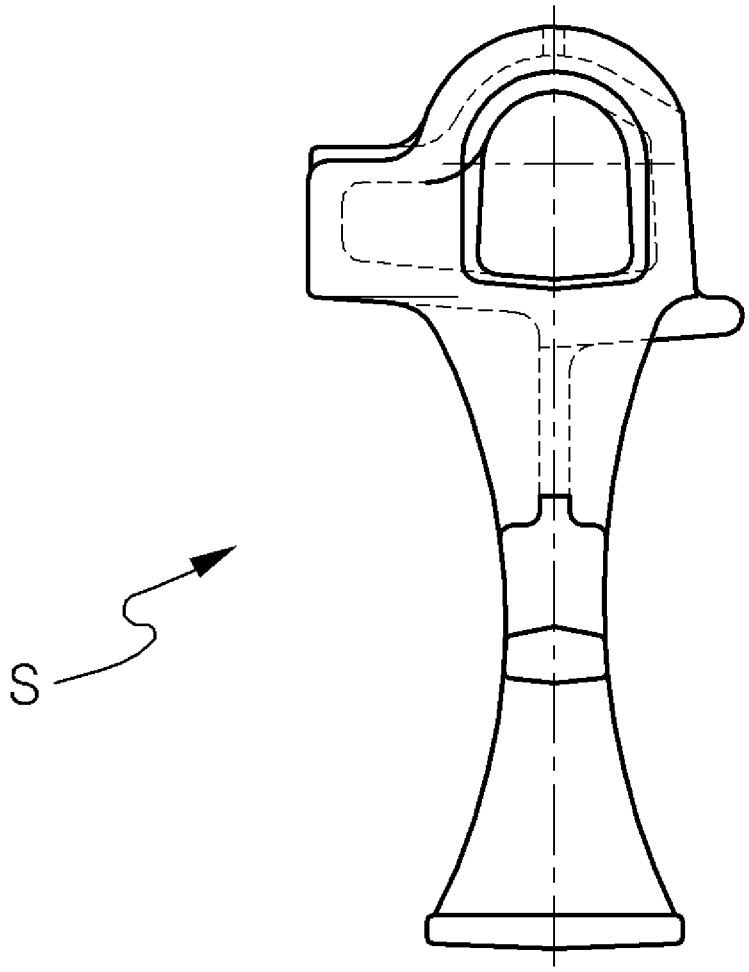

On the other hand, FIGS. 15 and 16 are views illustrating a clip shoulder in which an elastic clip for fixing a railway rail is installed according to an embodiment of the present invention.

As shown in the accompanying drawings, an elastic clip 100 for fixing a railway rail according to an embodiment of the present invention can be installed in various types of typical clip shoulders S.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An elastic clip for fixing a railway rail, comprising:

ahead arch having a front end to be inserted into a clip shoulder of a base plate or a tie;

a first arch extending in one piece from the head arch and upwardly curved in an oblique direction;

a first toe extending in one piece from the first front arch and disposed in a downward direction of the first arch and having a bottom surface to be contacted on a top surface of a flange of a rail;

a second arch extending in one piece from the first toe and upwardly curved in an oblique direction; and a second toe extending in one piece from the second arch and disposed in a downward direction of the second arch and having a front end, wherein the front end of the second toe is disposed under the head arch, and a top surface of the front end of the second toe contacts a bottom surface of the head arch.

2. The elastic clip of claim 1, wherein the elastic clip is configured such that the top surface of the front end of the second toe is spaced from the bottom surface of the head arch by about 0.2 mm to about 2.0 mm when the elastic clip is installed in the clip shoulder, and the top surface of the front end of the second toe contacts the bottom surface of the head arch when the rail is lifted in a state where the elastic clip is installed in the clip shoulder.

3. An elastic clip for fixing a railway rail, comprising:

a head arch having a front end to be inserted into a clip shoulder of a base plate or a tie;

a first arch extending in one piece from one end of the head arch and upwardly curved in an oblique direction;

a first toe extending in one piece from the first arch and disposed in a downward direction of the first arch and having a bottom surface to be contacted on a top surface of a flange of a rail;

a second arch extending in one piece from the first toe and upwardly curved in an oblique direction;

a second toe extending in one piece from the second arch and disposed in a downward direction of the second arch and having a front end;

a head arch front end extension extending in one piece from the other end of the head arch by a certain length in a straight line; and a third toe extending in one piece from the head arch front end extension and having a front end upwardly curved in an oblique direction, wherein the front end of the second toe is disposed under the head arch, and a top surface of the front end of the second toe contacts a bottom surface of the head arch.

4. The elastic clip of claim 3, wherein the third toe extends from the head arch by a length of about 2 mm to about 15 mm.

5. The elastic clip of claim 3, wherein a top surface of a front end of the third toe higher than a top surface of the head arch front end extension by a length of about 0.5 to about 3.0 mm.

6. The elastic clip of claim 4, wherein a top surface of a front end of the third toe higher than a top surface of the head arch front end extension by a length of about 0.5 to about 3.0 mm.

* * * * *